US005097511A

United States Patent [19]

Suda et al.

[11] Patent Number: 5,097,511

[45] Date of Patent: Mar. 17, 1992

[54] SOUND SYNTHESIZING METHOD AND APPARATUS

[75] Inventors: Norio Suda, Tokyo; Takahiro Suzuki, Chiba, both of Japan

[73] Assignee: Kabushiki Kaisha Meidensha, Tokyo, Japan

[21] Appl. No.: 540,864

[22] Filed: Jun. 20, 1990

Related U.S. Application Data

[63] Continuation of Ser. No. 181,211, Apr. 13, 1988, abandoned.

[30] Foreign Application Priority Data

| | | | |
|---|---|---|---|
| Apr. 14, 1987 | [JP] | Japan | 62-91705 |
| Jun. 15, 1987 | [JP] | Japan | 62-148184 |
| Jun. 15, 1987 | [JP] | Japan | 62-148185 |
| Dec. 18, 1987 | [JP] | Japan | 62-335476 |

[51] Int. Cl.[5] ..... G10L 5/00

[52] U.S. Cl. ..... 381/51; 395/2

[58] Field of Search ..... 381/51-53; 364/513.5

[56] References Cited

PUBLICATIONS

1CASSP 86 proceedings, vol. 3 of 4, 7th-11th, Apr. 1986, Tokyo, pp. 2011-2014, 1EEE, New York, W. Frank et al.: "Improved Vocal Tract Models for Speech Synthesis".

Flanagan, "Speech Analysis, Synthesis", Springer-Verlag, New York, 1965, pp. 45-68.

*Primary Examiner*—Emanuel S. Kemeny

*Attorney, Agent, or Firm*—Bachman & LaPointe

[57] ABSTRACT

A sound synthesizing method and apparatus for producing synthesized sounds having a property similar to the property of natural sounds emitted from a natural acoustic tube having a variable cross-sectional area. The natural acoustic tube is replaced by a series connection of a plurality of acoustic tubes each having a variable cross-sectional area. The acoustic tube series connection is replaced by an equivalent electric circuit connected between a power source circuit and a sound radiation circuit. The equivalent electric circuit includes a parallel connection of first and second electric circuits equivalent for adjacent first and second acoustic tubes of the acoustic tube series connection. The first electric circuit includes input and output side sections each including a propagated current source and a surge impedance element having a surge impedance inversely proportional to the cross-sectional area of the first acoustic tube. The second electric circuit includes input and output side sections each including a propagated current source and a surge impedance element having a surge impedance inversely proportional to the cross-sectional area of the second acoustic tube. A value for the current flowing in the radiation circuit is calculated to produce a synthesized sound component corresponding to the calculated value. Thereafter, similar calculations are repeated at uniform time intervals to produce a synthesized sound.

10 Claims, 9 Drawing Sheets

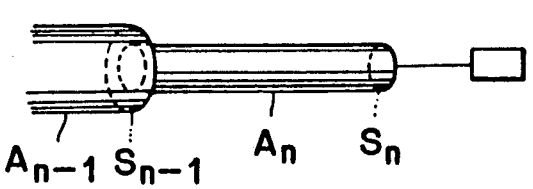
FIG. 4
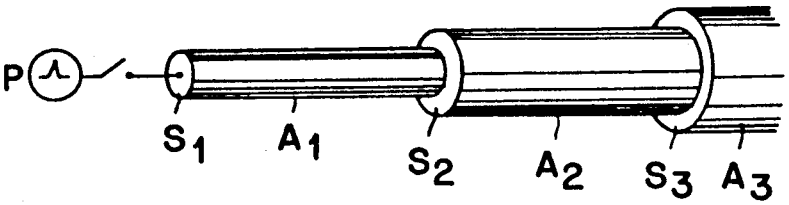
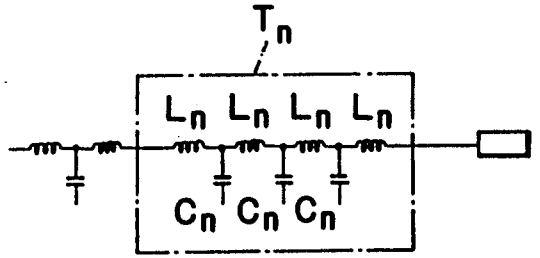
FIG. 5
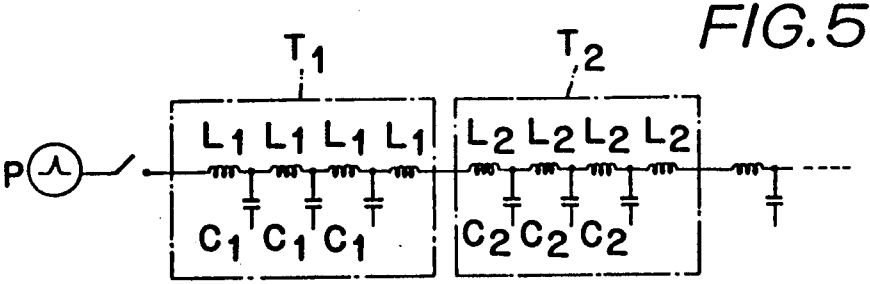
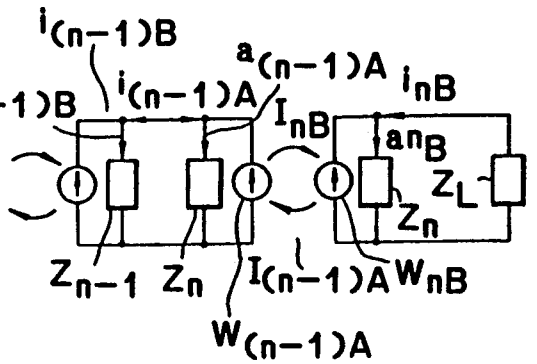
FIG. 6
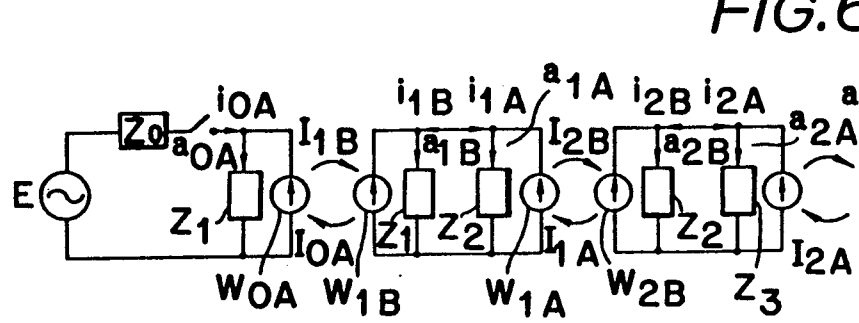

FIG. 18

| PHONEME | S | | | A | | |
|---|---|---|---|---|---|---|
| SECTION | $O_1$ | $O_2$ | $O_3$ | $O_1$ | $O_2$ | $O_3$ |
| TIME | $t_1$ | $t_2$ | $t_3$ | $t_1$ | $t_2$ | $t_3$ |
| PITCH | $P_1$ | $P_2$ | $P_3$ | $P_1$ | $P_2$ | $P_3$ |
| PITCH TIME CONSTANT | $DP_1$ | $DP_2$ | $DP_3$ | $DP_1$ | $DP_2$ | $DP_3$ |
| ENERGY | $E_1$ | $E_2$ | $E_3$ | $E_1$ | $E_2$ | $E_3$ |
| ENERGY TIME CONSTANT | $DE_1$ | $DE_2$ | $DE_3$ | $DE_1$ | $DE_2$ | $DE_3$ |
| SOUND SOURCE WAVE PATTERN | $G_1$ | $G_2$ | $G_3$ | $G_1$ | $G_2$ | $G_3$ |
| ACOUSTIC TUBE CROSS-SECTIONAL AREA | $A_{1-1}$ | $A_{1-2}$ | $A_{1-3}$ | - - | - - | - - |
| | $A_{2-1}$ | $A_{2-2}$ | $A_{2-3}$ | - - | - - | - - |
| | ⋮ | ⋮ | ⋮ | ⋮ | ⋮ | ⋮ |
| | $A_{17-1}$ | $A_{17-2}$ | $A_{17-3}$ | - - | - - | - - |
| PHONEME TIME CONSTANT | $DA_1$ | $DA_2$ | $DA_3$ | - - | - - | - - |

SOUND SYNTHESIZING METHOD AND APPARATUS

This is a continuation of co-pending application Ser. No. 181,211 filed on Apr. 13, 1988, now abandoned.

BACKGROUND OF THE INVENTION

This invention relates to a sound synthesizing method and apparatus for producing synthesized sounds having a property similar to the property of natural sounds such as human voices, instrumental sounds, or the like.

Sound synthesizers have been employed for producing synthesized sounds having a property similar to the property of natural sounds such as human voices, instrumental sounds, or the like. Technological advances particularly in large scale integrated circuit (LSI) techniques have permitted the production of inexpensive sound synthesizers. In cooperation with such technological advances, various sound synthesizing techniques, such as a recording/editing technique and a parameter extraction technique, have been developed to improve the fidelity of the synthesized sounds. The recording/editing technique records various human voices and edits the recorded human voices to form a desired sentence. The parameter extraction technique extracts parameters from human voices and adjusts the extracted parameters during a sound synthesizing process to form an artifical audio signal. The parameter extraction technique includes a parcol technique which can form an audio signal with high fidelity.

It is the common practice to process a sound wave by employing a digital computer which samples the sound wave at uniform time intervals, converts the sampled values into digital form, and stores the converted digital values into a computer memory. In order to produce a synthesized sound with high fidelity, it is required to sample the sound wave at fine time intervals and increase the computer memory capacity.

Various coding techniques have been developed to reduce the memory capacity required in producing synthesized sounds. For example, a digital modulation coding technique has been employed which codes a sound wave by assigning a binary number "1" to the newly sampled value when the next value is estimated as being greater than the new value and assigning a binary value "0" to the newly sampled value when the next value is estimated as being smaller than the new value. Such a technique is called as an estimated coding and includes a linear estimating technique which makes an estimation based on the several previously sampled values and a parcor technique which utilizes a parcor coefficient rather than the estimation coefficient used in the linear estimation technique.

With such an estimation coding technique, however, a serious problem occurs in coupling successive synthesized sounds. For example, when a vowel sound, a consonant sound and a vowel sound are produced in this order, an interruption occurs between the vowel sounds to produce an unnatural or artificial impression on a person. A similar problem occurs when instrumental sounds are synthesized artifically.

SUMMARY OF THE INVENTION

It is a main object of the invention to provide a simple and inexpensive sound synthesizing method and apparatus which can produce synthesized sounds having a property very similar to the property of natural sounds such as human voices, instrumental sounds, or the like with no interruption between successive synthesized sounds.

According to the invention, the fashion in which a sound wave travels through an acoustic tube having a variable cross-sectional area is analyzed by using an equivalent electric circuit having a variable surge impedance. Since the cross-sectional area of the acoustic tube is in inverse proportion to the surge impedance of the equivalent electric circuit, changes in the cross-sectional area of the acoustic tube can be simulated by changing the surge impedance of the equivalent electric circuit. It is possible to provide smooth sound coupling between successive synthesized sounds by continuously varying the surge impedance of the equivalent electric circuit. In addition, changes in the length of the acoustic tube can be simulated by changing the number of delay circuits provided in the equivalent electric circuit.

There is provided, in accordance with the invention, a sound synthesizing method and apparatus for producing synthesized sounds having a property similar to the property of natural sounds emitted from a natural acoustic tube having a variable cross-sectional area. The natural acoustic tube is replaced by a series connection of a plurality of acoustic tubes each having a variable cross-sectional area. The acoustic tube series connection is replaced by an equivalent electric circuit connected between a power source circuit and a sound radiation circuit. The equivalent electric circuit includes a parallel connection of first and second electric circuits equivalent for adjacent first and second acoustic tubes of the acoustic tube series connection. The first electric circuit includes input and output side sections each including a propagated current source and a surge impedance element having a surge impedance inversely proportional to the cross-sectional area of the first acoustic tube. The second electric circuit includes input and output side sections each including a propagated current source and a surge impedance element having a surge impedance inversely proportional to the cross-sectional area of the second acoustic tube. A value for the current flowing in the radiation circuit is calculated to produce a synthesized sound component corresponding to the calculated value. Thereafter, similar calculations are repeated at uniform time intervals to produce a synthesized sound.

BRIEF DESCRIPTION OF THE DRAWINGS

The invention will be described in greater detail by reference to the following description taken in connection with the accompanying drawings, in which:

FIG. 4 is a perspective view showing an acoustic model used in a first embodiment of the invention;

FIG. 5 is a circuit diagram showing an electric model equivalent for the sound model of FIG. 4;

FIG. 6 is a circuit diagram showing an equivalent electric circuit for the electric circuit of FIG. 5;

FIG. 18 is a table showing the parameters stored in the phoneme parameter memory of FIG. 17;

DETAILED DESCRIPTION OF THE INVENTION

Prior to the description of the preferred embodiments of the present invention, its principles will be described with reference to FIGS. 1 to 4 in order to provide a basis for a better understanding of the present invention.

In general, a man makes a vocal sound from his mouth by opening and closing his vocal folds to make intermittent breaks in his expriation so as to produce puffs. The puffs propagate through his vocal path leading from his vocal folds to his mouth to produce a vocal sound which is emitted from his mouth. The vocal folds is shown in the form of a sound source which produces an impulse P to the vocal path. When his vocal folds are in strain, they open and close at a high frequency to produce a high-frequency puff sound. The loudness of the puff sound is dependent on the intensity of his expriation.

Figure 1A:
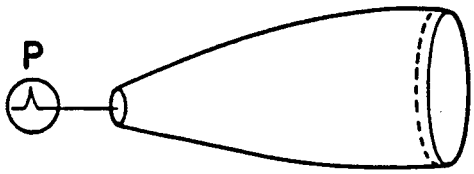
FIGS. 1A and 1B are schematic illustrations of two different human vocal path forms.
Figure 1B:
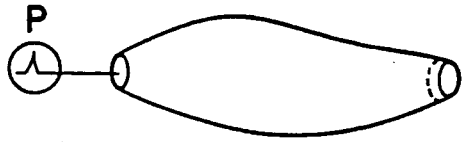

The vocal sound emitted from his mouth has a complex vowel sound waveform having some components emphasized and some components attenuated due to resonance produced while the puff sound passes his vocal path. Although the waveform of the vocal sound is not dependent on the waveform of the puff sound, but on the shape of his vocal path. That is, the vocal sound waveform is dependent on the length and cross-sectional area of the vocal path. If the vocal path has the same shape, the envelope of the spectrum of the vocal sound emitted from his mouth will be substantially the same regardless of the frequency of opening and closing movement of his vocal folds and the intensity of his expriation. Thus, the shape of his vocal path determines which vowel sound is emitted from his mouth. For example, when a Japanese vowel sound (アイ) is emitted from his mouth, his vocal path has such a shape as shown in FIG. 1A where it has a throttled end at his throat and a wide-open end at his lips. When a Japanese vowel sound (イ) is emitted from his mouth, his vocal path has such a shape as shown in FIG. 1B where it has an open end at his throat and a narrow-open end at his lips.

Figure 2:
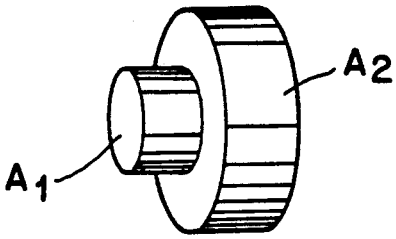
FIG. 2 is a perspective view showing adjacent two acoustic tubes of an acoustic model by which a natural acoustic tube is analyzed.

FIG. 2 shows two adjacent acoustic tubes of an acoustic model including a series connection of a plurality of acoustic tubes which can simulate a natural sound path such as a human vocal path, an instrumental sound path, or the like. The first and second acoustic tubes A1 and A2 are shown as having different cross-sectional areas. A part of the sound wave traveling through the first acoustic tube A1 reflects on the boundary between the first and second acoustic tubes A1 and A2 where there is a change in cross-sectional area. The reflected sound wave component is referred to as a retrograding sound wave and the sound wave component passing through the boundary to the second acoustic tube A2 is referred to as a progressive sound wave. The ratio of the progressive and retrograding sound waves is determined by the ratio of the cross sectional areas S1 and S2 of the respective acoustic tubes A1 and A2; that is, the ratio of the acoustic impedances of the respective acoustic tubes A1 and A2. The acoustic admittance Y1 of the first acoustic tube A1 is given as:

$$Y1=1/Z1=S1/(D\times C)$$

where Z1 is the acoustic impedance of the first acoustic tube A1, S1 is the cross-sectional area of the first acoustic tube A1. D is the density of the medium, for example, air through which the sound wave travels, and C is the velocity of the sound wave traveling through the medium. Similarly, the acoustic admittance T2 of the second acoustic tube A2 is given as:

$$Y2=1/Z2=S2/(D\times C)$$

where Z2 is the acoustic impedance of the first acoustic tube A2 and S2 is the cross-sectional area of the second acoustic tube A2. Thus, the total acoustic admittance Y of the acoustic model section including the adjacent two acoustic tubes A1 and A2 is given as:

$$Y=Y1+Y2=(S1+S2)/(D\times C)$$

Figure 3:
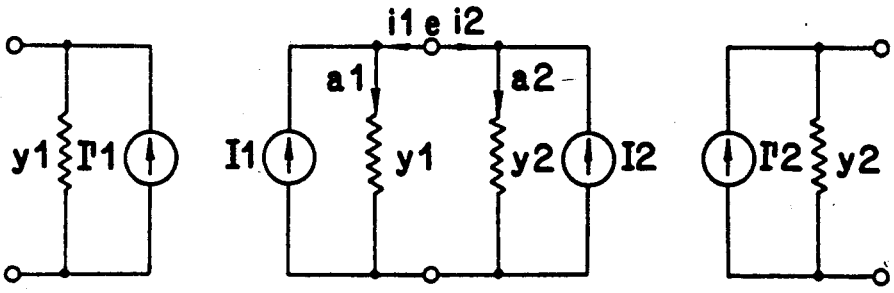
FIG. 3 is a circuit diagram showing adjacent two electric circuits by which the fashion in which a sound wave travels through the adjacent acoustic tubes of FIG. 2 is analyzed.

This phenomenon is substantially the same as a transient phenomenon which appears when a pulse current flows through a series connection of two electric lines having different electrical impedances. Thus, the acoustic model can be replaced by its equivalent electric circuit model section as shown in FIG. 3. The equivalent electric circuit model section includes a parallel connection of first and second electric circuits. The first electric circuit includes input and output side sections each including a propagated current source and a surge impedance element having a surge impedance inversely proportional to the cross-sectional area of the first acoustic tube A1. The second electric circuit includes input and output side sections each including a propagated current source and a surge impedance element having a surge impedance inversely proportional to the cross-sectional area of the second acoustic tube A2. In FIG. 3, the characters a1, a2, i1 and i2 designates the currents flowing through the respective lines affixed with the corresponding characters when the values I1 and I2 are for the respective propagated current sources in the circuit block. The character e designates a voltage developed at the junction between the output side section of the first electric circuit and the input side section of the second electric circuit. The voltage e is represented as:

$$\begin{aligned} e &= (1/Y) \times (I1 + I2) \\ &= \{(D \times C) \times (I1 + I2)\} \times (I1 + I2) \end{aligned}$$

The currents a1 and a2 are given as:

$$\begin{aligned} a1 &= Y1 \times e \\ &= (Y1/Y) \times (I1 + I2) \\ &= \{S1/(S1 + S2)\} \times (I1 + I2) \end{aligned}$$

$$\begin{aligned} a2 &= Y2 \times e \\ &= (Y2/Y) \times (I1 + I2) \\ &= \{S2/(S1 + S2)\} \times (I1 + I2) \end{aligned}$$

Since $a1=i1+I1$ and $a2=i2+I2$, $i1=ai-I1$ and $i2=a2-I$. Thus, the current I1' propagated from this circuit block to the input side section of the first electric circuit is calculated as:

$$I1'=i1+a1$$

Since $i1=a1-I1$, this equation is rewrite as:

$$I1'=2\times a1-I1$$

Similarly, the current I2' propagated from this circuit block to the output side section of the second electric circuit is calculated as:

$$I2'=i2+a2$$

Since $i2=a2-I1$, this equation is rewrite as:

$$I2'=2\times a2-I1$$

Referring to FIG. 4, there is illustrated an acoustic model by which the fashion in which a sound wave travels through a natural sound path is analyzed. This acoustic model includes a series connection of n acoustic tubes A1 to An each having a variable cross-sectional area. The acoustic tubes A1 to An are shown as having cross-sectional areas S1 to Sn, respectively. The first acoustic tube A1 is connected to a sound source which produces an impulse P thereto. The acoustic model can be replaced by an electric circuit model which includes a series connection of n circuit elements T1 to Tn each comprising a surge impedance component having no resistance, as shown in FIG. 5. An electrical pulse P is applied to the first circuit element T1. Since the cross-sectional area of each of the acoustic tubes A1 to An is in inverse proportion to the surge impedance of the corresponding one of the circuit elements T1 to Tn, the fashion in which the cross-sectional area of the acoustic tube changes can be simulated by changing the surge impedance of the corresponding circuit element. In addition, the fashion in which the impulse P applied to the first acoustic tube A1 changes can be simulated by changing the amplitude of the electric pulse P applied to the first circuit element T1. The current outputted from the last circuit element Tn is applied to drive a loudspeaker or the like to produce a synthesized sound.

Referring to FIG. 6, there is illustrated an equivalent electric circuit for the electric circuit model of FIG. 5. The equivalent electric circuit is connected between a power source circuit and a sound radiation circuit. In FIG. 6, the character E designates a power source, the character Z0 designates an electrical impedance of the power source E, the characters Z1 to Zn designate electrical surge impedances of the respective circuit elements T1 to Tn, and the character 2L designates the radiation impedance. The surge impedances Z1, Z2, . . . Zn, which are in inverse proportion to the cross-sectional areas of the respective acoustic tubes A1, A2, . . . An and in direct proportion to the sound velocity, are represented as $Z1=(D\times C)/S1$, $Z2=(D\times C)/S2$, . . . and $Zn=(D\times C)/Sn$ where D is the air density, C is the sound velocity, S1 is the cross-sectional area of the first acoustic tube A1, S2 is the cross-sectional area of the second acoustic tube A2, and Sn is the cross-sectional area of the last acoustic tube An. The characters i0A to i(n−1)A, i1B to inB, and a1B to anB designate the values of the currents flowing through the respective current paths affixed with the corresponding characters. The characters W0A to W(n−1)A, and W1B to WnB designate propagated current sources. The characters I0A to I(n−1)A designate retrograding wave currents and the characters I1B to InB designate progressive wave currents.

Figure 7:
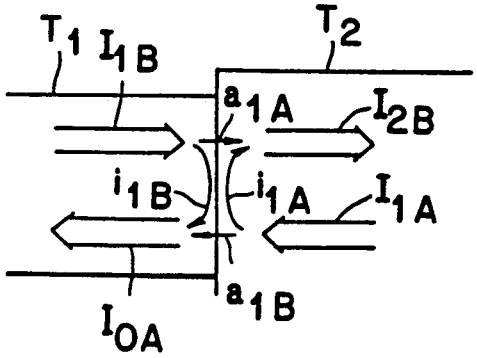
FIG. 7 is a diagram used in explaining the progressive-wave and retrograding-wave currents propagated to the adjacent circuits.

Referring to FIG. 7, considerations are made to the connection between the first and second circuit elements T1 and T2. The propagated current source W0A is supposed as producing a propagated current I1B which is divided into a reflected-wave current i1B reflected on the bondary between the first and second circuit elements T1 and T2 and a transmitted-wave current a1A transmitted to the second circuit element T2. Similarly, the propagated current source W1A is supposed as producing a propagated current I1A which is divided into a reflected-wave current i1A reflected on the boundary between the first and second circuit elements T1 and T2 and a transmitted-wave current a1B transmitted through the boundary to the first circuit element T1. Thus, the current I0A is equal to the sum of the currents i1B and a1B and the current I2B is equal to the sum of the currents i1A and a1A. These considerations can be applied to the other connections.

Figure 8:
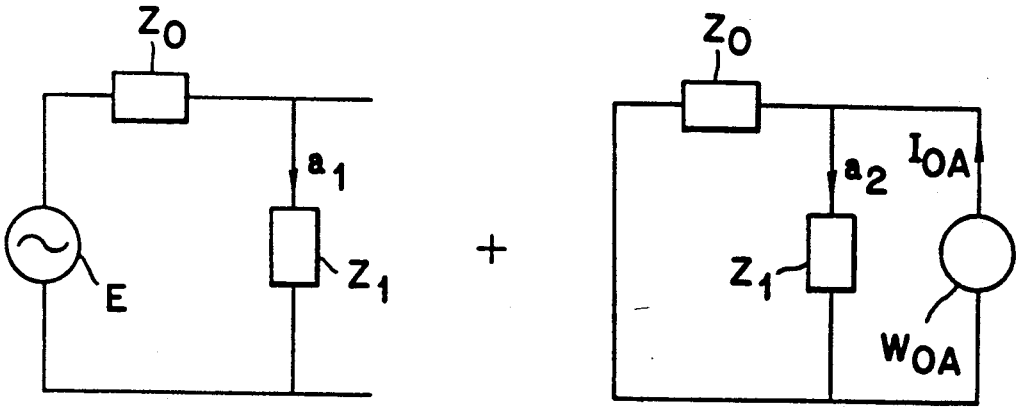
FIG. 8 is a circuit diagram used in explaining the manner in which a value is calculated for the current flowing in the surge impedance element of the first circuit block of the equivalent electric circuit of FIG. 7.

The first circuit block including the power source E can be considered as it is divided into two circuits, as shown in FIG. 8. Assuming now that E is the voltage of the power source E, the currents a1 and a2 are calculated as:

$$a1=E/(Z0+Z1)$$

$$a2=I0A\times Z0/(Z0+Z1)$$

Thus, the current a0A is calculated as:

$$\begin{aligned} a0A &= a1 + a2 \\ &= (E + Z0 \times I0A)/(Z0 + Z1) \end{aligned}$$

To emit a Japanese vowel sound (ア), impulses P may be applied to the sound model with its acoustic tubes having their several cross-sectional areas to simulate the shape of a human vocal path obtained when he pronounces the Japanese vowel sound (ア). Similarly, to emit a Japanese vowel sound (イ), impulses P may be applied to the sound model with its acoustic tubes having their several cross-sectional areas to simulate the shape of his vocal path obtained when he pronounces the Japanese vowel sound (ﾉ).

Figure 9:
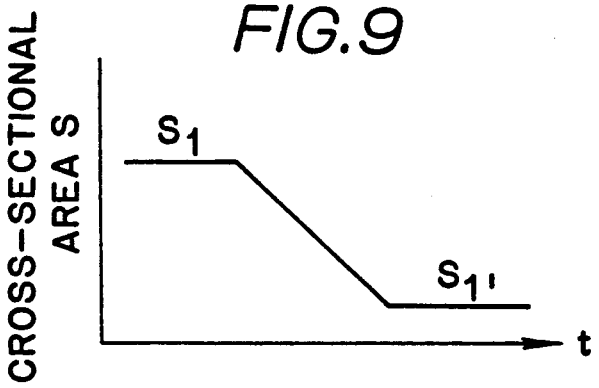
FIGS. 9 and 10 are graphs used in explaining the sound synthesizing operation performed according to the first embodiment of the invention.
Figure 10:
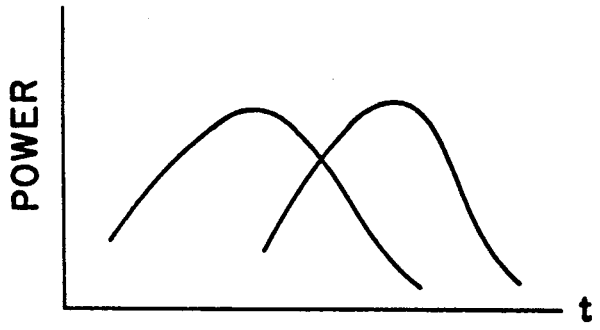

FIG. 9 shows a linear interpolation used in varying the cross-sectional area of each of the acoustic tubes from a value to another value with respect to time during a transient state where the sound to be synthesized is changed from a Japanese vowel sound (ﾅ) to a Japanese vowel sound (ﾉ). Such a change in the cross-sectional area of each of the acoustic tubes can be simulated by gradually varying the surge impedance of each of the circuit elements to produce intermediate sounds between the Japanese vowel sounds (ﾅ) and (ﾉ). This is effective to provide smooth coupling between successive synthesized sounds, as shown in FIG. 10.

Figure 11:
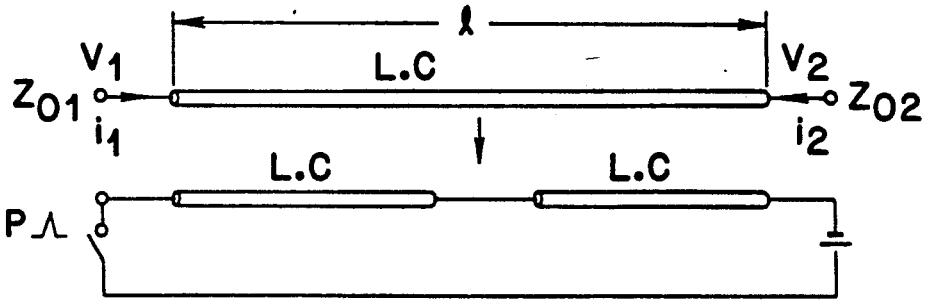
FIG. 11 is a schematic diagram showing an acoustic model used in explaining time delays produced during the sound synthesizing operation.
Figure 12:
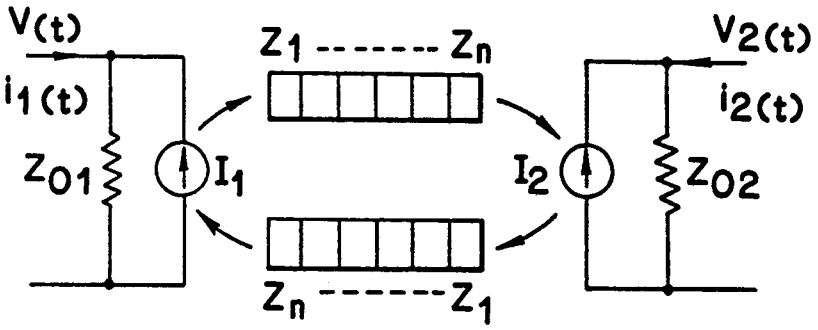
FIG. 12 is a circuit diagram showing an equivalent electric circuit for the acoustic model of FIG. 11.

The velocity of the sound wave traveling through the acoustic model can be analyzed by a transient phenomenon which appear when a pulse current flows through an electric LC line, as shown in FIG. 11. FIG. 12 shows an equivalent electric circuit for the electric LC line of FIG. 11. The surge impedance Z01 viewed from one end of the electric LC line is represented as:

$$Z01 = \sqrt{L/C}$$

The surge impedance of the electric LC circuit as viewed from the other end is represented as:

$$Z02 = \sqrt{L/C}\ .$$

The propagated currents I1 and 2 are given as:

$$I1 = i2 \times (t-\tau) + V2 \times (T-\tau) \times (1/Z02)$$

$$I2 = i1 \times (t-\tau) + V1 \times (t-\tau) \times (1/Z01)$$

Delay circuits Z1 to Zn are located between the input and output side sections of each of the circuit elements T1 to Tn to delays the current I1 propagated from the output side section to the input side section and the current I2 propagated from the input side section to the output side section. The number of the delay circuits located between the input and outputs side sections corresponds to the time required for the sound wave to travel between the leading and trailing ends of the corresponding one of the acoustic tubes.

The sound synthesizing apparatus employs a digital computer which should be regarded as including a central processing unit (CPU), a memory, and a digital-to-analog converter (D/A). The computer memory includes a read only memory (ROM) and a random access memory (RAM). The central processing unit communicates with the rest of the computer via data bus. The read only memory contains the program for operating the central processing unit and further contains apropriate parameters for each kind of sounds to be synthesized. These parameters include power source voltages E1, E2, . . . and impedances Z0, Z1, Z2, . . . Zn and ZL used in calculating appropriate synthesized sound component values forming the corresponding synthesized sound. The parameters are determined experimentally or logically. For example, the values E1, E2, . . . are determined by sampling, at uniform intervals, a sound wave produced from a natural sound source. The values Z1, Z2, . . . Zn are determined as $Z1=(D\times C)/S1$, $Z2=(D\times C)/S2$, . . . $Zn=(D\times C)/Sn$ where D is the density of the medium through which the sound wave travels, C is the velocity of the sound wave traveling through the medium, S1 is the cross-sectional area of the first acoustic tube, S2 is the ross-sectional area of the second acoustic tube, and Sn is the cross-sectional area of the nth acoustic tube. The random access memory includes memory sections assigned to the respective propagated current sources W0A, W1B, W1A, . . . WnB for storing calculated propagated current values I0A, I1B, I1A, . . . InB. The calculated appropriate synthesized sound component value is periodically transferred by the central processing unit to the digital-to-analog converter which converts it into analog form. The digital-to-analog converter produces an analog audio signal to a sound radiating unit. The sound radiating unit includes an amplifier for amplifying the analog audio signal to drive a loudspeaker.

The programming of the digital computer as it is used to calculate appropriate synthesized sound component values will be apparent from the following description made with reference to FIGS. 4 to 7. It is now assumed that synthesized sound component calculations are performed to produce a synthesized sound similar to a human voice composed of puff sounds (impulses P) produced from a sound source at variable time intervals, for example, determined by the intervals at which the puff sounds are produced. The program is start ed to perform one calculation cycle at uniform time intervals of 100 microseconds.

In order to perform the first calculation cycle, the computer program is started at an appropriate time t1. First of all, the digital computer central processing unit reads values E1, I0A, Z0 and Z1 from the computer memory and calculates new values a0A' and i0A' for the divided currents developed in the presence of the voltage E1. These calculations are performed as follows:

$$\begin{aligned} a0A' &= f(E1, I0A) \\ &= (E1 + Z0 \times I0A)/(Z0 + Z1) \\ i0A' &= a0A' - I0A. \end{aligned}$$

The calculated new divided current values a0A' and i0A' are used to calculate a new value I1B' for the current propagated from the first block to the second block. This calculation is performed as follows:

$$I1B' = i0A' + a0A'$$

At a time t2, the digital computer central processing unit reads the values I1B, I1A, Z1 and Z2 from the computer memory and calculates new values a1B', a1A', i1B' and i1A' for the divided currents developed in the second block. The interval between the times t1 and t2 corresponds to the time period during which a progressive sound wave travels from the leading end of the first acoustic tube A1 to the leading end of the second acoustic tube A2. These calculations are performed as follows:

$$a1B' = Z1B \times (I1B + I1A)$$

$$a1A' = Z1A \times (I1B + I1A)$$

$$i1B' = a1B' - I1B$$

$$i1A' = a1A' - I1A$$

where $Z1B=Z2/(Z1+Z2)$ and $Z1A=Z1/(Z1+Z2)$. The calculated new divided current values a1B', a1A', i1B' and i1A' are used to calculate a new value I0A' for the current propagated from the second block to the first block and a new value I2B' for the current propagated from the second block to the third block. These calculations are performed as:

$$I0A'=i1B'+a1B'$$

$$I2B'=i1A'+a1A'$$

At a time t3, the digital computer central processing unit reads the values I2B, I2A, Z2 and Z3 from the computer memory and calculates new values a2B', a2A', i2B' and i2A' for the divided currents developed in the third block. The interval between the times 2 and 3 corresponds to the time period during which a progressive sound wave travels from the leading end of the second acoustic tube A2 to the leading end of the third acoustic tube A3. These calculations are made as follows:

$$a2B'=Z2B\times(I2B+I2A)$$

$$a2A'=Z2A\times(I2B+I2A)$$

$$i2B'=a2B'-I2B$$

$$i2A'=a2A'-I2A$$

Where $Z2B=Z3/(Z2+Z3)$ and $Z2A=Z2/(Z2+Z3)$. The calculated new divided current values a2B', a2A', i2B' and i2A' are used to calculate a new value I1A' for the current propagated from the third block to the second block and a new value I3B' for the current propagated from the third block to the fourth block. These calculations are performed as follows:

$$I1A'=i2B'+a2B'$$

$$I3B'=i2A'+a2A'$$

Similar calculations are performed for the other blocks. Thus, at a time tn which corresponds to the time at which a progressive sound wave reaches the leading end of the nth acoustic tube An, the digital computer central processing unit reads the values I(n−1)B, I(n−1)A, Z(n−1) and Zn from the computer memory and calculates new values a(n−1)B', a(n−1)A', i(n−1)B', and i(n−1)A' for the divided currents developed in the (n−1)th block. These calculations are performed as follows:

$$a(n-1)B'=Z(n-1)B\times(I(n-1)B+I(n-1)A)$$

$$a(n-1)A'=Z(n-1)A\times(I(n-1)B+I(n-1)A)$$

$$i(n-1)B'=a(n-1)B'-I(n-1)B$$

$$i(n-1)A'=a(n-1)A'-I(n-1)A$$

where $Z(n-1)B=Z(n)/(Z(n-1)+Z(n))$ and $Z(n-1)A=Z(n-1)/(Z(n-1)+Z(n))$. The calculated new divided current values a(n−1)B', a(n−1)A', i(n−1)B' and i(n−1)A' are used to calculate a new values I(n−2)A' for the current propagated from the (n−1)th block to the (n−2)th block and a new value InB' for the current propagated from the (n−1)th block to the nth block. These calculations are performed as follows:

$$I(n-2)A'=i(n-1)B'+a(n-1)B'$$

$$InB'=i(n-1)A'+a(n-1)A'$$

At the time t(n+1) which corresponds to the time at which a progressive sound wave is emitted from the trailing end of the last acoustic tube An, the digital computer central processing unit reads the values InB, Zn and ZL from the computer memory and calculates new values anB' and inB' for the divided currents developed in the nth block. These calculations are performed as follows:

$$\begin{aligned} anB' &= f(InB) \\ &= InB\times Zn/(Zn+ZL) \end{aligned}$$

$$inB'=anB'-InB$$

The calculated divided current new values anB' and inB' are used to calculate a new value I(n−1)A' for the current propagated from the nth block to the (n−1)th block. This calculation is performed as follows:

$$I(n-1)A'=inB'+anB'$$

The calculated new divided current value inB' is transferred to the digital-to-analog circuit which converts it into analog form. The calculated new propagated current values I1B', I0A', I2B', . . . I(n−2)A', InB' and I(n−1)A' are used to update the respective old values I1B, I0A, I2B, . . . I(n−2)A, InB, and I(n−1)A stored in the random access memory. The analog audio signal is applied from the digital-to-analog converter to drive the loudspeaker which thereby produces a synthesized sound component. Thereafter, the program is ended.

Since the program is started at uniform time intervals of 100 microseconds, similar calculation cycles are repeated at uniform time intervals of 100 microseconds. It is to be noted that, at the time when one calculation cycle is started, the random access memory sections store propagated current values updated during the calculation cycle followed by the one calculation cycle. It is also to be noted that the digital computer center processing unit reads a voltage value computer center processing unit reads a voltage value E2 to calculate new values a0A' and i0A' for the divided currents when the program is entered to perform the second calculation cycle and it reads a voltage value Ei to calculate new values a0A' and i0A' when the program is entered to perform the ith calculation cycle.

As can be seen from the foregoing description, adjacent first and second acoustic tubes Ai and Ai+1 of the acoustic tube series connection of the acoustic model of FIG. 4 are analyzed by using an equivalent electric circuit including a parallel connection of first and second electric circuits. The first electric circuit includes input and output side sections each including a propagated circuit source and a surge impedance element having a surge impedance Zi inversely proportional to the cross-sectional area Si of the first acoustic tube A1. The second electric circuit includes input and output side sections each including a propagated circuit source and a surge impedance element having a surge impedance Zi+1 inversely proportional to the cross-sectional area Si+1 of the second acoustic tube Ai+1.

Calculations are made for each circuit block including the output side section of the first electric circuit and the input side section of the second electric circuit. First of all, an old first value for the propagated current source of the output side section of the first electric circuit, an old second value for the propagated current source of the input side section of the second electric circuit, a first parameter related to the surge impedance element of the output side section of the first electric circuit, and a second parameter related to the surge impedance element of the input side section of the second electric circuit are read. Following this, values of the divided currents flowing in the output side section of the first electric circuit and values for the divided currents flowing in the input side section of the second electric circuit are calculated based on the read old first and second values and the read first and second parameters. A new value for the propagated current source of the input side section of the first electric circuit and a new value for the propagated current source of the output side section of the second electric circuit are calculated based on the calculated divided current values. Similar calculations are repeated for the following circuit blocks until a value for the current flowing in the radiation circuit is calculated. This calculated current value is transferred to the digital-to-analog converter which converts it into a corresponding analog audio signal. Following this, the old value for the propagated current source of the input side section of the first electric circuit is replaced by the new value calculated therefor and the old value for the propagated current source of the output side section of the second electric circuit is replaced by the new value calculated therefor. The analog audio signal is used to drive a loudspeaker so as to produce a synthetic sound component. It is to be noted that the first and second parameters may be Si/(Si+Si+1) and Si+1/(Si+Si+1), respectively, where Si is the cross-sectional area of the acoustic tube Ai and Si+1 is the cross-sectional area of the acoustic tube Ai+1. Alternatively, the first and second parameters may be $ri^2/(ri^2+ri+1^3)$ and $ri+1^2/(ri^2+ri+1^3)$, respectively, where ri is the radius of the acoustic tube Ai and ri+1 is the radius of the acoustic tube Ai+1.

Figure 13:
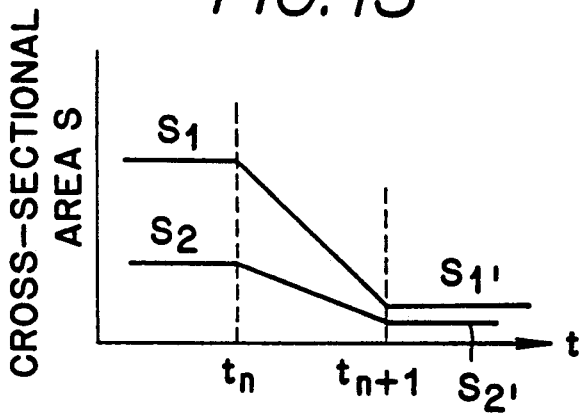
FIGS. 13 and 14 are graphs used in explaining the sound synthesizing operation according to a modified form of the first embodiment of the invention.
Figure 14:
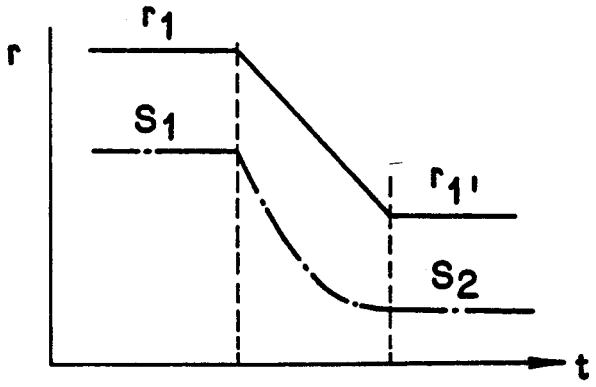

FIG. 13 shows a linear interpolation used in varying the cross-sectional areas of the acoustic tubes from a value to another value with respect to time during a transient state where the sound to be synthesized is changed. FIG. 14 shows a linear interpolation used in varying the radius of the acoustic tube from a value to another value with respect to time during a transient state where the sound to be synthesized is changed. In FIG. 14, the one-dotted curve indicates changes in the cross-sectional area of the acoustic tube during the transient state where the radius of the acoustic tube changes.

Figure 15:
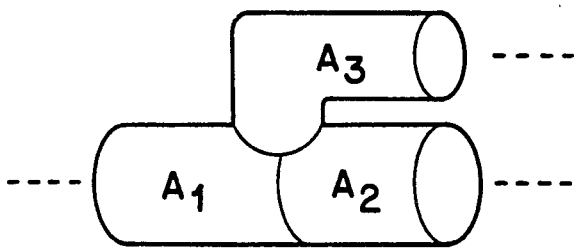
FIG. 15 is a perspective view showing a part of an acoustic model used in a second embodiment of the invention.

Referring to FIG. 15, there is illustrated an acoustic model used in a second embodiment of the invention where his nasal cavity is taken into account. This acoustic model includes acoustic tubes A1 and A2 connected in series with each other and an acoustic tube A3 diverged from the portion at which the acoustic tubes A1 and A2 are connected. The diverged acoustic tube A3 corresponds to his nassal cavity. The acoustic admittances Y1, Y2 and Y3 of the respective acoustic tubes A1, A2 and A3 are given as:

$$Y1=S1/(D\times C)$$

$$Y2=S2/(D\times C)$$

$$Y3=S3/(D\times C)$$

where S1 is the cross-sectional area of the acoustic tube A1, S2 is the cross-sectional area of the acoustic tube A2, S3 is the cross-sectional area of the acoustic tube A3, D is the air density, and C is the sound velocity.

Figure 16:
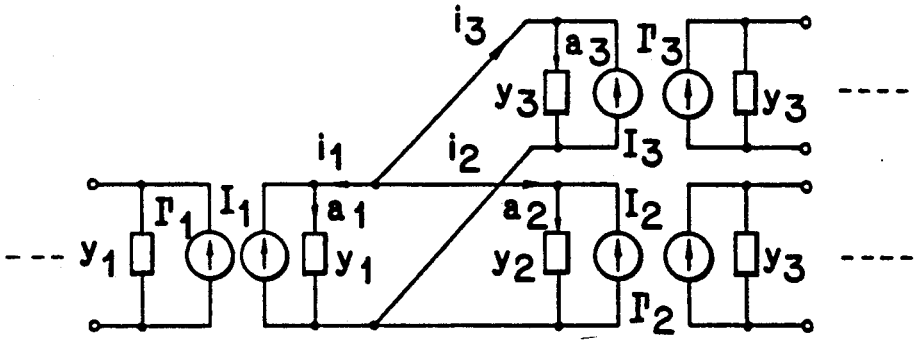
FIG. 16 is a circuit diagram showing an equivalent electric circuit for the acoustic model of FIG. 15.

The acoustic model can be replaced by its equivalent electric circuit as shown in FIG. 16. It is now assumed that the characters I1, I2 and I3 designate old values for the respective propagated current sources. These old values are read from the computer memory in a similar manner as described previously. The characters a1, a2, a3, i1, i2 and i3 designates the divided currents flowing through the respective lines affixed with the corresponding characters in the presence of the propagated currents I1, I2 and I3. The divided currents 1, a2 and a3 are calculated as:

$$a1=(I1+I2+I3)\times S1/(S1+S2+S3)$$

$$a2=(I1+I2+I3)\times S2/(S1+S2+S3)$$

$$a3=(I1+I2+I3)\times S3/(S1+S2+S3)$$

The divided currents i1, i2 and i3 are calculated as:

$$i1=a1-I1$$

$$i2=a2-I2$$

$$i3=a3-I3$$

The currents I1', I2' and I3' propagated to the adjacent circuit blocks are calculated as:

$$I1'=i1+a1$$

$$I2'=i2+a2$$

$$I3'=i3+a3$$

The condition where the nasal cavity is closed can be simulated by zeroing the cross-sectional area S3 of the acoustic tube A3. It is possible to produce a synthesized sound mixed with a component similar to a human nasal tone by grandually varying the cross-sectional area of the acoustic tube A3. In addition, human sounds (ℓ) and (r) can be simulated with ease by utilizing the acoustic model of FIG. 15 and its equivalent electric circuit model of FIG. 16 since his vocal path is divided into two paths when his tongue is put into contact with his palate.

Figure 17:
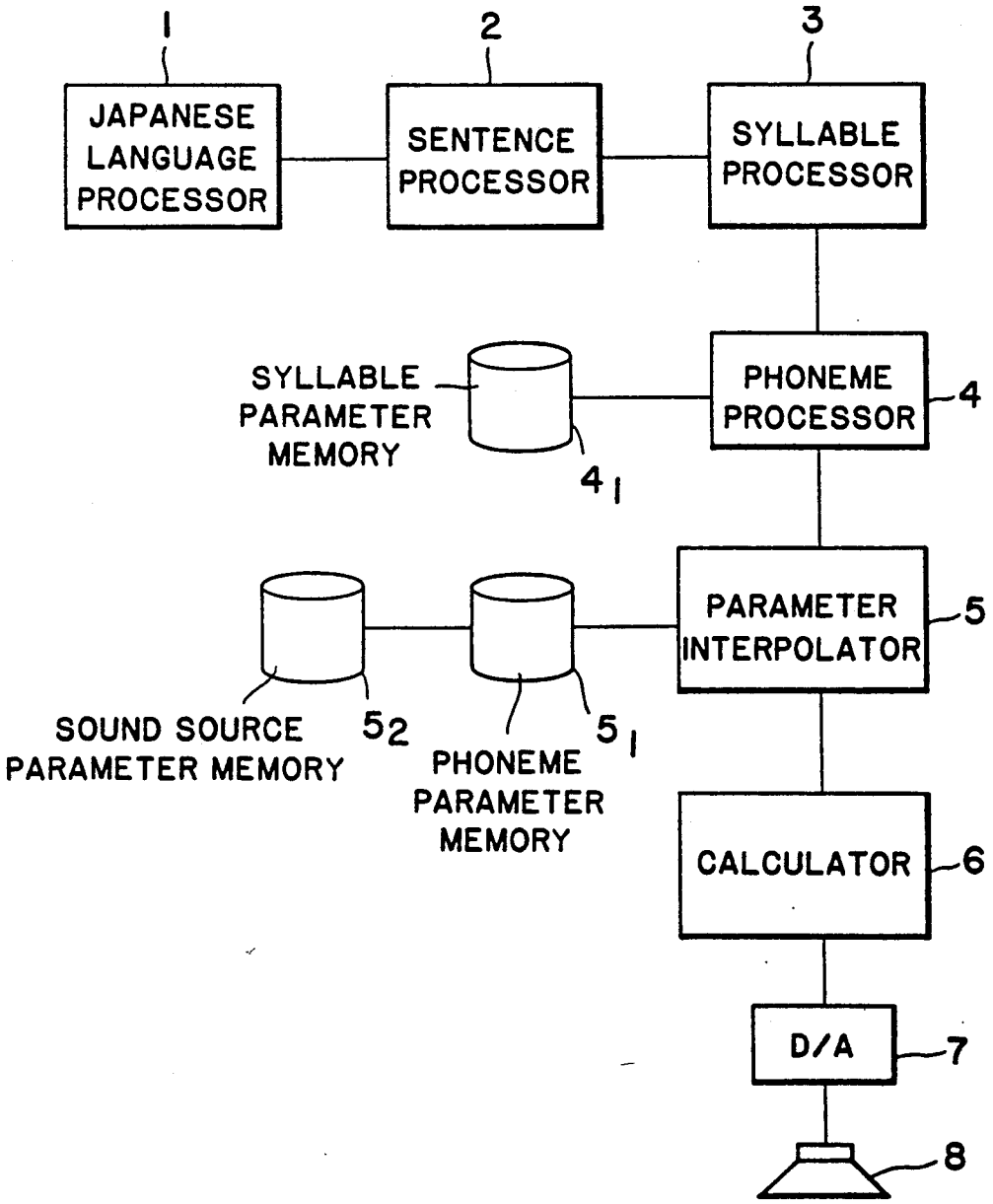
FIG. 17 is a block diagram showing a sound synthesizing apparatus of the invention.

Referring to FIG. 17, there is illustrated a third embodiment of the sound synthesizing apparatus of the invention. The sound synthesizing apparatus includes a Japanese language processing circuit 1 to which Japanese sentences are inputted successively from a word processor or the like. Description will be made on an assumption that a Japanese sentence "SAKURA GA SAITA" is inputted to the Japanese language processing circuit 1. The japanese language processing circuit 1 converts the inputted sentence "SAKURA GA SAITA" into Japanese syllabes (SA), (KU), (RA), (GA), (SA), (I) and (TA). The Japanese language processing circuit 1 is coupled to a sentence processing circuit 2 which places appropriate intonation to the Japanese sentence fed thereto from the Japanese sentence processing circuit 1. The sentence processing circuit 2 is coupled to a syllable processing circuit 3 which places appropriate accents on the respective syllables (SA), (KU), (RA), (GA), (SA), (I) and (TA) according to the intonation placed on the Japanese sentence in the sentence processing circuit 2. Since the intonation is determined by several parameters including the pitch (repetitive period) and energy of the sound wave, the placement of appropriate accents on the respective syllables is equivalent to determination of the coefficients for the respective parameters.

The syllable processing circuit 3 is coupled to a phoneme processing circuit 4 which is also coupled to a syllable parameter memory 41. The phoneme processing circuit 4 divides an inputted syllable into phonemes with reference to a relationship stored in the syllable parameter memory 41. This relationship defines phonemes to which the inputted syllable is to be divided. For example, when the phoneme processing circuit 4 receives a syllable (SA) from the syllable processing circuit 3, it divides the syllable (SA) into two phonemes (S) and (A).

Figure 20:
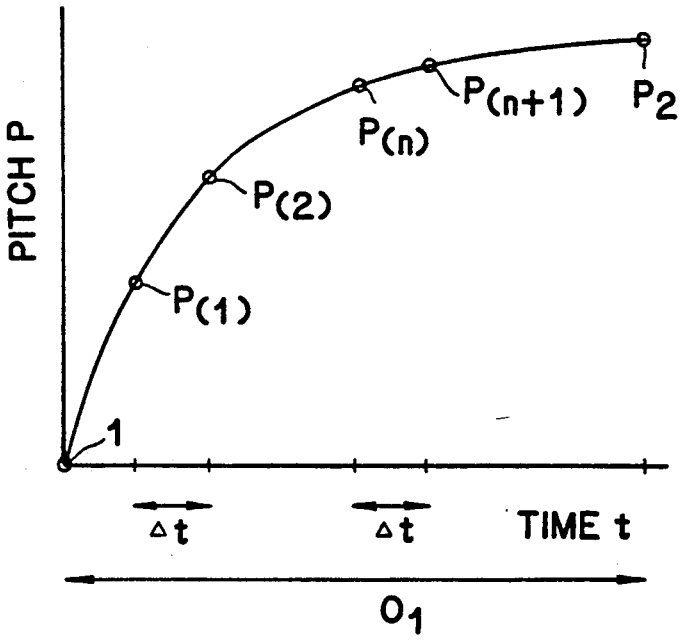
FIG. 20 is a graph showing the interporating operation performed in the sound synthesizing apparatus.

The phoneme processing circuit 4 produces the divided phonemes to a parameter interpolation circuit 5. The parameter interpolation circuit 5 is coupled to a phoneme parameter memory 51 and also to a sound source parameter memory 52. The phoneme parameter memory 51 stores phoneme parameter data for each phoneme. As shown in FIG. 20, the phoneme parameter data include various phoneme parameters including section time period, sound wave pitch, pitch time constant, sound wave energy, energy time constant, sound wave pattern, acoustic tube cross-sectional area, and phoneme time constant for each of a predetermined number of (in the illustrated case three) time sections 01, 02 and 03 into which the time period during which the corresponding phenome such as (S) or (A) is pronounced is divided. The section time periods t1, t2 and t3 represent the time periods of the respective time sections 01, 02 and 03. The sound wave pitches p1, p2 and p3 represent the pitches of the sound wave produced in the respective time sections 01, 02 and 03. The pitch time constant DP1 represents the manner in which the pitch P1 changes from its initial value obtained when the first time section 01 starts to its target value obtained when the first time section 01 is terminated. The pitch time constant DP2 represents the manner in which the pitch P2 changes from its initial value obtained when the second time section 02 starts to its target value obtained when the second time section 02 is terminated. The pitch time constant DP3 represents the manner in which the pitch P3 changes from its initial value obtained when the third time section 03 starts to its target value obtained when the third time section 03 is terminated. The sound wave energy E1, E2 and E3 represent the energy of the sound wave produced in the respective time sections O1, O2 and O3. The energy time constant DE1 represents the manner in which the energy E1 changes from its initial value obtained when the first time section O1 starts to its target value obtained when the first time section O1 is terminated. The energy time constant DE2 represents the manner in which the energy E2 changes from its initial value obtained when the second time section O2 starts to its target value obtained when the second time section O2 is terminated. The energy time constant DE3 represents the manner in which the energy E3 changes from its initial value obtained when the third time section O3 starts to its target value obtained when the third time section O3 is terminated. The sound wave patterns G1, G2 and G3 represent the patterns of the sound wave produced in the respective time sections O1, O2 and O3. The acoustic tube cross-sectional areas A1-1, A2-1, . . . A17-1 represent the cross-sectional areas of the first, second, . . . and 17th acoustic tubes in the first time section O1. The cross-sectional area of the first acoustic tube changes from the value A1-1 to a value A1-2 in the second time section O2 and to a value A1-3 in the third time section O3. The cross-sectional area of the second acoustic tube changes from the value A2-1 to a value A2-2 in the second time section O3 and to a value A2-3 in the third time section O3. Similarly, the cross-sectional area of the 17th acoustic tube changes from the value A17-1 to a value A17-2 in the second time section O2 and to a value A17-3 in the third time section O3. It is to be noted that, in the illustrated case, the acoustic model has 17 acoustic tubes to simulate a human vocal path having a length of about 17 cm.

Figure 19:
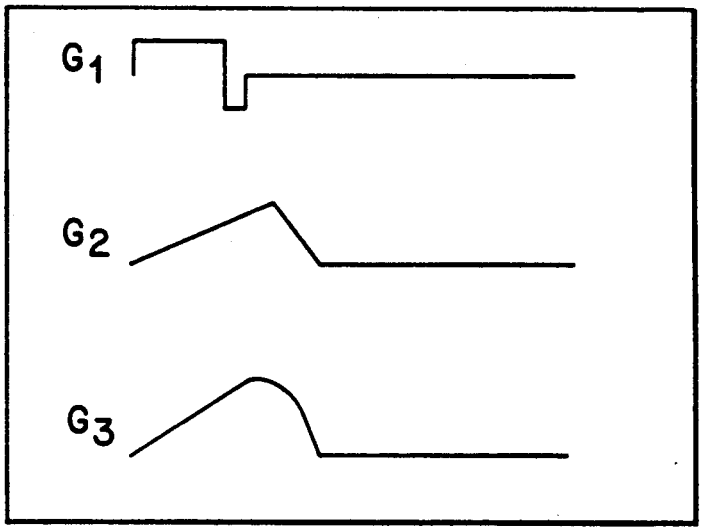
FIG. 19 is a diagram showing the sound wave patterns stored in the sound source parameter memory of FIG. 17.

The sound source parameter memory 52 has sound source parameter data stored therein. The sound source parameter data include 100 values obtained by sampling a first sound wave pattern G1 at uniform time intervals, 100 values obtained by sampling a second sound wave pattern G2 at uniform time intervals, and 100 values obtained by sampling a third sound wave pattern G3 at uniform time intervals, as shown in FIG. 19.

The parameter interpolation circuit 5 perform a predetermined number of (in this case n) interpolations for each of the parameters, which includes sound wave pitch, sound wave energy, and acoustic tube cross-sectional area, in each of the time sections O1, O2 and O3. Assuming now that XO is the initial value of a parameter in a time section, Xr is the target value of the parameter in the time section, and D is the time constant for the parameter, the nth interpolated value X(n) is given as:

$$X(n)=D\times\{Xr-X(n-1)\}+X(n-1)$$

This equation is derived from the following equation:

$$X=Xr-e^{-DT}$$

The both sides of this equation are differentiated to obtain:

$$dx/dt = De^{-Dt}$$

$$\begin{aligned} dx &= X(n+1)-X(n) = dt\times De^{-Dt(n)} \\ &= dt\times D\times\{Xr-X(n)\} \end{aligned}$$

This equation is rewrite as:

$$X(n+1)=dt\times D\times\{Xr-X(n)\}+X(n)$$

Since interpolations are performed at uniform time intervals, dt X D may be replaced by D to obtain:

$$X(n)=D\times\{Xr-X(n-1)\}+X(n-1)$$

For example, interpolations for the pitch parameter in the first time section O1 is performed as follows: since the initial value XO of the pitch parameter is P1, the target value Xr of the pitch parameter is P2, and the time constant D of the pitch parameter is DP1, the first interpolated value P(1) is calculated as:

$$P(1) = DP1 \times \{Xr - P(0)\} + P(0)$$
$$= DP1 \times (P2 - P1) + P1$$

The nth interpolated value X(n) is calculated as:

$$P(n) = DP1 \times \{P2 - P(n-1)\} + P(n-1)$$

As shown in FIG. 20, these interpolated values P(1), P(2), P(n), P(n+1) and P2 are located on a curve represented as $P = P2 - e^{-DT}$.

The reference numeral 6 designates a calculation circuit which employs a digital computer. The calculation circuit 6 receives sampled and interpolated data from the interpolation circuit 5 to calculate a digital value for the current inB flowing in the radiation circuit at uniform time intervals, for example, of 100 microseconds. The calculated digital value is transferred to a digital-to-analog converter (D/A) 7 which converts it into a corresponding analog audio signal. The analog audio signal is applied to drive a loudspeaker 8 which thereby produces a synthesized sound component.

What is claimed is:

1. A sound synthesizing method for producing synthesized sounds having a property similar to the property of natural sounds emitted from a natural acoustic tube having a variable cross-sectional area, comprising the steps of:

simulating a natural acoustic tube with a series connection of at least first and second acoustic tubes each having a variable cross-sectional area;

simulating the acoustic tube series connection with an equivalent electric circuit model including parallel connection of first and second electric circuits corresponding to the first and second acoustic tubes, respectively, each of the first and second electric circuits including input and output side sections, each input side section including a first propagated current source and a first surge impedance element connected in parallel with the first propagated current source, the first surge impedance element having a surge impedance value inversely proportional to the cross-sectional area of the corresponding acoustic tube, each output side section including a second propagated current source and a second surge impedance element connected in parallel with the second propagated current source, the second surge impedance element having a surge impedance value inversely proportional to the cross-sectional area of the corresponding acoustic tube, the input side section of the first electric circuit being connected to a power source circuit having a surge impedance, the output side section of the second electric circuit being connected to a radiation circuit having a surge impedance, determining a first current value representing the current produced by the first propagated current source of the first electric circuit into a first block constituted by the power source circuit and the input side section of the first electric circuit from a second block constituted by the output side section of the first electric circuit and the input side section of the second electric circuit, determining a second current value representing the current produced by the second propagated current source of the first electric circuit into the second block from the first block, determining a third current value representing the current produced by the first propagated current source of the second electric circuit into the second block from a third block constituted by the output side section of the second electric circuit and the radiation circuit, determining a fourth current value representing the current produced by the second propagated current source of the second electric circuit into the third block from the second block;

simulating propagation of a power from the power source through the simulated equivalent electric circuit model to the radiation circuit with a computer and calculating a fifth current value representing the current flowing in the radiation circuit; and producing a synthesized sound component corresponding to the calculated fifth current value.

2. The sound synthesizing method as claimed in claim 1, wherein the step of calculating a value representing the current flowing in the radiation circuit includes the steps of:

(a) determining a value representing a voltage produced from the power source circuit and an old value for the first current propagated to the first block from the second block, calculating values representing divided currents flowing in the first block using the determined voltage and first current values along with a value representing the surge impedance of the power source circuit and a value representing the surge impedance of the input side section of the first electric circuit, calculating a new value for the second current propagated from the first block to the second block using the calculated divided current values, updating the old value of the second current propagated from the first block to the second block with the new value calculated therefor;

(b) a first predetermined time after step (a), determining an old value for the second current propagated to the second block from the first block and an old value for the third current propagated to the second block from the third block, calculating values representing divided currents flowing in the second block using the determined second and third current old values along with a value representing the surge impedance of the output side section of the first electric circuit and a value representing the surge impedance of the input side section of the second electric circuit, calculating a new value for the first current propagated from the second block to the first block and a new value for the fourth current propagated from the second block to the third block, and updating the old value of the first current propagated from the second block to the first block with the new value calculated therefor and the old value of the fourth current propagated from the second block to the third block with the new value calculated therefor;

(c) a second predetermined time after step (b), determining an old value for the fourth current propagated to the third block from the second block, calculating a value for a sixth current representing the current flowing through the surge impedance element of the output side section of the second electric circuit and a value for the fifth current flowing through the radiation circuit using the previously determined current values along with a value representing the surge impedance of the output side section of the second electric circuit and a value representing the surge impedance of the radiation circuit, calculating a new value for the third current propagated from the third block to the second block, and updating the old value of the third current propagated from the third block to the second block with the new value calculated therefor; and repeating the above sequence of steps (a), (b) and (c) at uniform time intervals to produce a synthesized sound.

3. The sound synthesizing method as claimed in claim 2, wherein the voltage value of the simulated power source circuit corresponds to a sound wave applied to the acoustic tube serial connection.

4. The sound synthesizing method as claimed in claim 3, wherein the first predetermined time corresponds to a time required for a sound wave to travel through the simulated first acoustic tube and the second predetermined time corresponds to a time required for the sound wave to travel through the simulated second acoustic tube.

5. The sound synthesizing method as claimed in claim 2, wherein the value of the surge impedance of the input and output side sections of the first electric circuit is given as Si/(Si+Si+1) and the value of the surge impedance of the input and output side sections of the second electric circuit is given as Si+1/(Si+Si+1) where Si is the cross-sectional area of the first acoustic tube and Si+1 is the cross-sectional area of the second acoustic tube.

6. The sound synthesizing method as claimed in claim 2, wherein the value of the surge impedance of the input and output side sections of the first electric circuit is given as $ri^2/(ri^2+ri+1^2)$ and the value of the surge impedance of the input and output side sections of the second electric circuit is given as $ri+1^2/(ri^2+ri+1^2)$ where ri is the radius of the first acoustic tube and ri+1 is the radius of the second acoustic tube.

7. The sound synthesizing method as claimed in claim 1, wherein the fifth current value is calculated using parameters interpolated in each of a predetermined number of time sections into which the time period during which a phoneme is pronounced is divided.

8. The sound synthesizing method as claimed in claim 7, wherein the parameters are interpolated according to the following equation:

$$X(n)=D\times(Xr-X(n-1))+X(n-1)$$

where X(n) is the nth interpolated value for the parameter, Xr is a target value for the parameter, and D is a time constant for the parameter.

9. The sound synthesizing method as claimed in claim 7, wherein the parameters include acoustic tube cross-sectional area, sound wave energy, and sound wave pitch.

10. The sound synthesizing method as claimed in claim 1, wherein:

the simulated natural acoustic tube has a diverged portion represented by at least one additional acoustic tube diverged from a connection between the first and second acoustic tubes, the at least one additional acoustic tube having a variable cross-sectional area;

representing said at least one additional acoustic tube by a simulated third electric circuit including input and output side sections with the input side section including a first propagated current source and a first surge impedance element connected in parallel with the first propagated current source, the first surge impedance element having a surge impedance value inversely proportional to the cross-sectional area of the at least one additional acoustic tube, the output side section including a second propagated current source and a second surge impedance element connected in parallel with the second propagated current source, the second surge impedance element having a surge impedance value inversely proportional to the cross-sectional area of the at least one additional acoustic tube, the input side section of the third electric circuit being connected in parallel with the output side section of the first electric circuit, and the output side section of the third electric circuit being connected to a radiation circuit having a surge impedance;

determining a seventh current value representing a current produced by the first propagated current source of the third electric circuit from the output side section of the third electric circuit to the input side section of the third electric circuit; and determining an eighth current value representing a current produced by the second propagated current source of the third electric circuit from the input side section of the third electric circuit to the output side section of the third electric circuit.

* * * * *